US010809670B2

(12) United States Patent
Hashimoto

(10) Patent No.: US 10,809,670 B2
(45) Date of Patent: Oct. 20, 2020

(54) TIMING APPARATUS, TIMING METHOD, AND ELECTRONIC APPLIANCE

(71) Applicant: SEIKO EPSON CORPORATION, Tokyo (JP)

(72) Inventor: Keisuke Hashimoto, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 165 days.

(21) Appl. No.: 15/256,348

(22) Filed: Sep. 2, 2016

(65) Prior Publication Data

US 2017/0075315 A1 Mar. 16, 2017

(30) Foreign Application Priority Data

Sep. 16, 2015 (JP) ..... 2015-182810

(51) Int. Cl.
*G04B 3/02* (2006.01)
*G04G 3/02* (2006.01)
*G04F 10/00* (2006.01)

(52) U.S. Cl.
CPC ..... *G04G 3/02* (2013.01); *G04F 10/00* (2013.01)

(58) Field of Classification Search
CPC ..... G04G 9/00; G04G 9/0076; G04G 9/08; G04G 9/087; G04F 10/00; G04B 3/02
See application file for complete search history.

(56) References Cited

U.S. PATENT DOCUMENTS 4,058,971 A * 11/1977 Epperson ..... G04F 10/04 368/112
4,074,516 A * 2/1978 Kondo ..... G04G 13/023 368/248
4,104,864 A * 8/1978 Ishikawa ..... G04G 9/0076 368/187
4,123,896 A * 11/1978 Asano ..... G04G 9/0076 368/187
4,154,053 A * 5/1979 Chetelat ..... G04G 5/02 368/186
4,253,169 A * 2/1981 Salah ..... G04G 9/0064 368/15

(Continued)

FOREIGN PATENT DOCUMENTS

JP S52-150076 A 12/1977
JP S52-150670 A 12/1977

(Continued)

*Primary Examiner* — Sean Kayes
(74) *Attorney, Agent, or Firm* — Oliff PLC

(57) ABSTRACT

The invention provides a timing apparatus that can generate timing information regarding a plurality of regions without performing a complex calculation that uses software and without causing a significant increase in electric current consumption. The timing apparatus includes: a lower counter that generates a count value that indicates a time in seconds; a first group of upper counters that generates a first group of count values that indicate a time in minutes, hours, days, months and years by performing a count operation in synchronization with the count operation performed by the lower counter; and a second group of upper counters that generates a second group of count values that indicate a time in minutes, hours, days, months and years by performing a count operation in synchronization with the count operation performed by the lower counter.

10 Claims, 6 Drawing Sheets

(56) References Cited

U.S. PATENT DOCUMENTS

| | | | | | |
|---|---|---|---|---|---|
| 4,303,995 | A * | 12/1981 | Aizawa | G04G 9/087 | 368/28 |
| 6,069,848 | A * | 5/2000 | McDonald | G04G 9/00 | 368/107 |
| 2003/0081507 | A1* | 5/2003 | Kitazawa | G04G 9/0082 | 368/21 |
| 2006/0050616 | A1* | 3/2006 | Brock | G04B 45/0076 | 368/10 |
| 2009/0135675 | A1 | 5/2009 | Akiyama | | |
| 2009/0274011 | A1* | 11/2009 | Fujisawa | G04R 20/10 | 368/47 |
| 2016/0187858 | A1* | 6/2016 | Matsue | G04R 20/06 | 368/47 |

FOREIGN PATENT DOCUMENTS

| | | | |
|---|---|---|---|
| JP | S55-103495 | A | 8/1980 |
| JP | S60-122384 | A | 6/1985 |
| JP | 2819573 | B2 | 10/1998 |
| JP | 2006-170855 | A | 6/2006 |
| JP | 2009-128296 | A | 6/2009 |

* cited by examiner

TIMING APPARATUS, TIMING METHOD, AND ELECTRONIC APPLIANCE

BACKGROUND

1. Technical Field

The present invention relates to a timing apparatus and a timing method that generate timing information by performing a timing operation by using a clock signal. Furthermore, the invention relates to an electronic appliance that uses such a timing apparatus, and the like.

2. Related Art

For example, in order to eliminate the complexity of setting the date and time to local date and time in an overseas travel destination, a watch has been developed that can display the local time at the overseas travel destination by selecting the name of the overseas travel destination. In such a watch, the local time of the selected region is calculated based on the time difference between the selected region and a reference time, which is the time set at the current place before heading to the overseas travel destination.

As a related technique, JP-A-2006-170855 (paragraph 0016, FIG. 6) discloses a world time watch that, even when a trip to a plurality of foreign countries is made, can set the current time in the destination country with ease and at an appropriate timing. The world time watch includes: a timing unit that times a reference time; a time difference setting unit that sets a time difference with respect to the reference time; a current time application unit that applies either one of the reference time and a zone time calculated by adding or subtracting the time difference to or from the reference time as the current time; an application time setting unit that sets an application time, which is the timing at which the zone time is applied as the current time, by using the reference time; a storage unit that stores therein the time difference and the application time in association with each other; and a control unit that calculates the zone time when the reference time reaches the application time and causes the current time application unit to apply the zone time as the current time.

According to JP-A-2006-170855 (paragraph 0016, FIG. 6), by setting the time difference before a trip is made, the current time adjusted with the time difference is automatically applied according to the itinerary of the trip. It is therefore possible to eliminate the need to set the time upon arriving at a travel destination and prevent the user from forgetting the time setting or prevent the user from setting the time to a wrong local time.

In general, the relationship between the reference time set at the current place and the zone time in the overseas travel destination may involve a time difference over two days or a leap year. Accordingly, in the case where the zone time in the overseas travel destination is calculated based on the reference time set at the current place by using software through computation, a CPU having a sufficient processing capability is required. However, with a low power consumption application such as a watch, it is difficult to secure a CPU having a sufficient processing capability. If the CPU does not have a sufficient processing capability, the timing information cannot be generated within a practical period of time.

Meanwhile, it is conceivable to provide a real time clock (RTC) having a plurality of channels corresponding to a plurality of regions, but the real time clock is problematic in that a frequency divider circuit that divides an original oscillation clock signal and a counter that counts the time in seconds require high electric current consumption, and the electric current consumption increases in proportion to the number of channels.

SUMMARY

Accordingly, to address the problems described above, a first advantage of some aspects of the invention is to provide a timing apparatus and a timing method that can generate timing information regarding a plurality of regions without performing a complex calculation that uses software and without causing a significant increase in electric current consumption. A second advantage of some aspects of the invention is to provide an electronic appliance that uses such a timing apparatus, and the like.

In order to solve at least a part of the problems described above, a timing apparatus according to a first aspect of the invention includes: a frequency divider circuit that generates a frequency-divided clock signal by dividing an original oscillating clock signal; a lower counter that generates a count value that indicates a time in seconds by performing a count operation in synchronization with the frequency-divided clock signal generated by the frequency divider circuit; a first group of upper counters that generates a first group of count values that indicate a time in minutes, hours, days, months and years by performing a count operation in synchronization with the count operation performed by the lower counter based on a first group of initial count values; and a second group of upper counters that generates a second group of count values that indicate a time in minutes, hours, days, months and years by performing a count operation in synchronization with the count operation performed by the lower counter based on a second group of initial count values.

According to the first aspect of the invention, one frequency divider circuit generates a frequency-divided clock signal, one lower counter performs a per-second timing operation in synchronization with the frequency-divided clock signal, and the first group of upper counters and the second group of upper counters perform a count operation based on their initial count values in synchronization with the count operation performed by the lower counter. Accordingly, it is possible to generate timing information regarding a plurality of regions without performing a complex calculation that uses software and without causing a significant increase in electric current consumption.

Here, each group of upper counters may include: a second counter that generates a second count value that indicates a time in minutes; a third counter that generates a third count value that indicates a time in hours; a fourth counter that generates a fourth count value that indicates a time in days; a fifth counter that generates a fifth count value that indicates a time in months; and a sixth counter that generates a sixth count value that indicates a time in years, and the fourth counter may control count operations performed by the fifth counter and the sixth counter and resets the fourth count value by comparing the fourth count value with an upper limit count value set based on the fifth count value and the sixth count value. With this configuration, each group of upper counters can independently perform processing for setting the last day of the month and management of leap years for the corresponding region.

In this case, in the first group of upper counters, the third counter may maintain an interval of performing control to advance with a count operation performed by the fourth counter at a constant interval, and in the second group of upper counters, the third counter may change the interval of performing control to advance with the count operation performed by the fourth counter based on the fourth count value and the fifth count value. With this configuration, the second group of upper counters can generate timing information so as to follow a change in the length of one day caused by summer time.

The timing apparatus as described above may further include an interrupt circuit that outputs an interrupt signal in response to a change in the count value output from the lower counter or at least one of the counters included in the first group of upper counters and the second group of upper counters. With this configuration, it is possible to perform an alarm operation or the like at the corresponding time in the desired region.

Also, the timing apparatus may further include a backup power supply that supplies a power supply voltage to an oscillator circuit that generates the original oscillating clock signal through an oscillation operation, the frequency divider circuit, the lower counter, the first group of upper counters and the second group of upper counters. With this configuration, it is possible to continuously perform the timing operation even if power supply from an external source stops.

An electronic appliance according to a second aspect of the invention includes: the timing apparatus having any one of the configurations described above; and a control portion that sets the first group of initial count values in the first group of upper counters based on a time set for a first region and sets the second group of initial count values in the second group of upper counters based on the time set for the first region and a time difference in a second region. With this configuration, by setting the current time in the first region, the current time in the second region can also be set.

A timing apparatus according to a third aspect of the invention includes: a frequency divider circuit that generates a frequency-divided clock signal by dividing an original oscillating clock signal; a lower timing portion that generates timing information regarding a time in seconds by performing a timing operation by using the frequency-divided clock signal generated by the frequency divider circuit; a first upper timing portion that generates timing information regarding a time in a first region in minutes, hours, days, months and years by performing a timing operation by using the timing information generated by the lower timing portion; and a second upper timing portion that generates timing information regarding a time in a second region in minutes, hours, days, months and years by performing a timing operation by using the timing information generated by the lower timing portion.

According to the third aspect of the invention, one frequency divider circuit generates a frequency-divided clock signal, one lower timing portion performs a per-second timing operation by using the frequency-divided clock signal, and the first and second upper timing portions generate timing information in the corresponding region by using the timing information generated by the lower timing portion. Accordingly, timing information regarding a plurality of regions can be generated without performing a complex calculation that uses software and without causing a significant increase in electric current consumption.

An electronic appliance according to a fourth aspect of the invention includes any one of the timing apparatuses described above. According to the fourth aspect of the invention, timing information regarding a plurality of regions can be generated without performing a complex calculation that uses software and without causing a significant increase in electric current consumption, and thus even a low power consumption electronic appliance that uses a CPU having a low processing capability can readily generate timing information regarding a plurality of regions.

A timing method according to a fifth aspect of the invention includes: (a) generating a frequency-divided clock signal by dividing an original oscillating clock signal; (b) generating timing information regarding a time in seconds by performing a timing operation by using the frequency-divided clock signal generated in (a): (c) generating timing information regarding a time in a first region in minutes, hours, days, months and years by performing a timing operation by using the timing information generated in (b); and (d) generating timing information regarding a time in a second region in minutes, hours, days, months and years by performing a timing operation by using the timing information generated in (b).

According to the fifth aspect of the invention, in step (a), a frequency-divided clock signal is generated. In step (b), a per-second timing operation is performed by using the frequency-divided clock signal. In steps (c) and (d), timing information generated through the per-second timing operation is used to generate timing information in each region. Accordingly, it is possible to generate timing information regarding a plurality of regions without performing a complex calculation that uses software and without causing a significant increase in electric current consumption.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
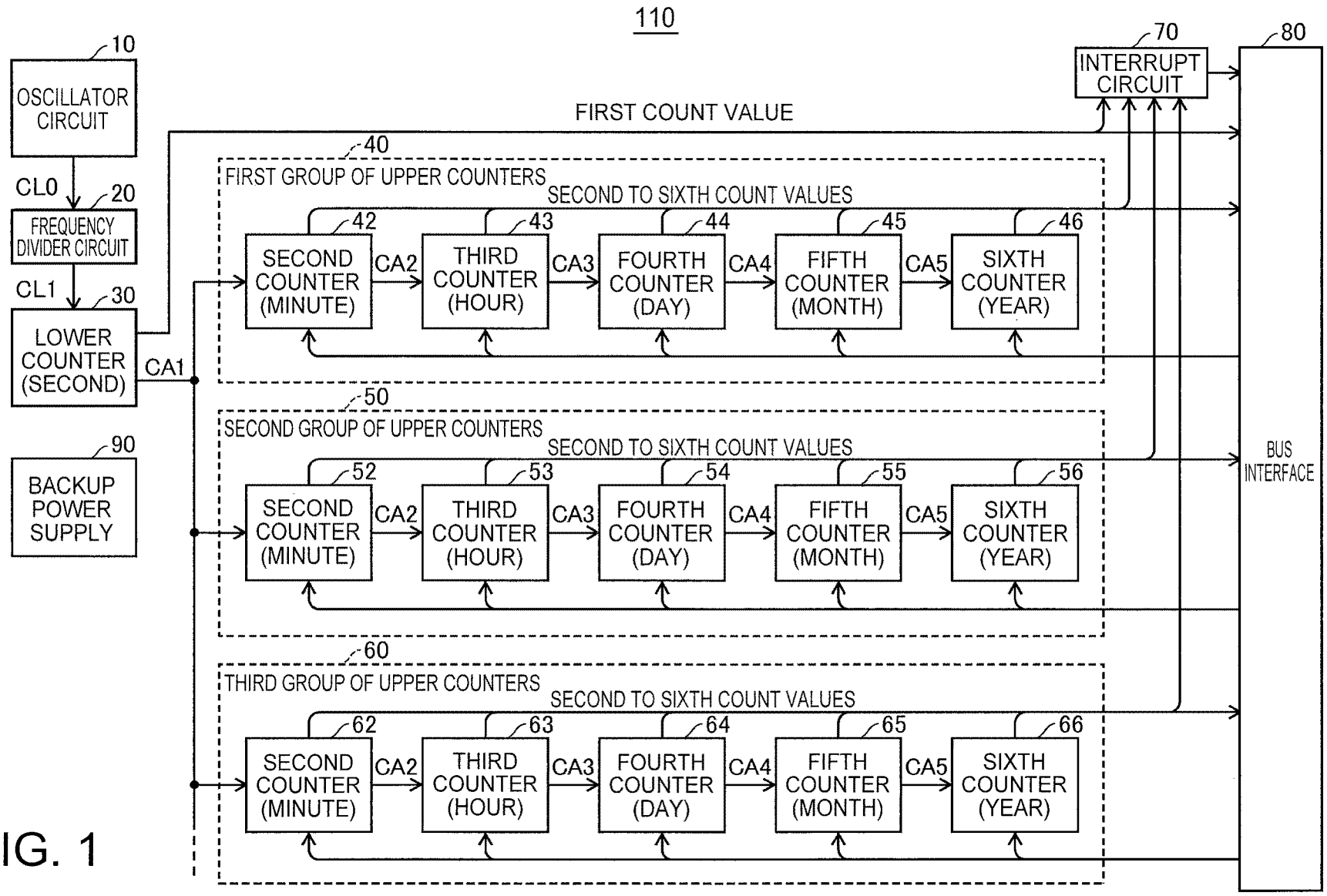
FIG. 1 is a block diagram showing an example configuration of a timing apparatus according to a first embodiment of the invention.

Hereinafter, embodiments of the invention will be described in detail with reference to the drawings. Like constituent elements are given like reference numerals, and a redundant description is omitted.

Timing Apparatus

FIG. 1 is a block diagram showing an example configuration of a timing apparatus according to a first embodiment of the invention. As shown in FIG. 1, a timing apparatus 110 includes an oscillator circuit 10, a frequency divider circuit 20, a lower counter 30 and a plurality of groups of upper counters 40, 50, 60 and so on, and the timing apparatus 110 has a real time clock (RTC) function. Furthermore, the timing apparatus 110 may include an interrupt circuit 70, a bus interface 80 and a backup power supply 90.

The oscillator circuit 10 generates an original oscillating clock signal CL0 having a frequency of, for example, 32,768 Hz by performing an oscillation operation. As the oscillator circuit 10, for example, a crystal oscillator circuit that uses a crystal oscillator can be used.

Figure 2:
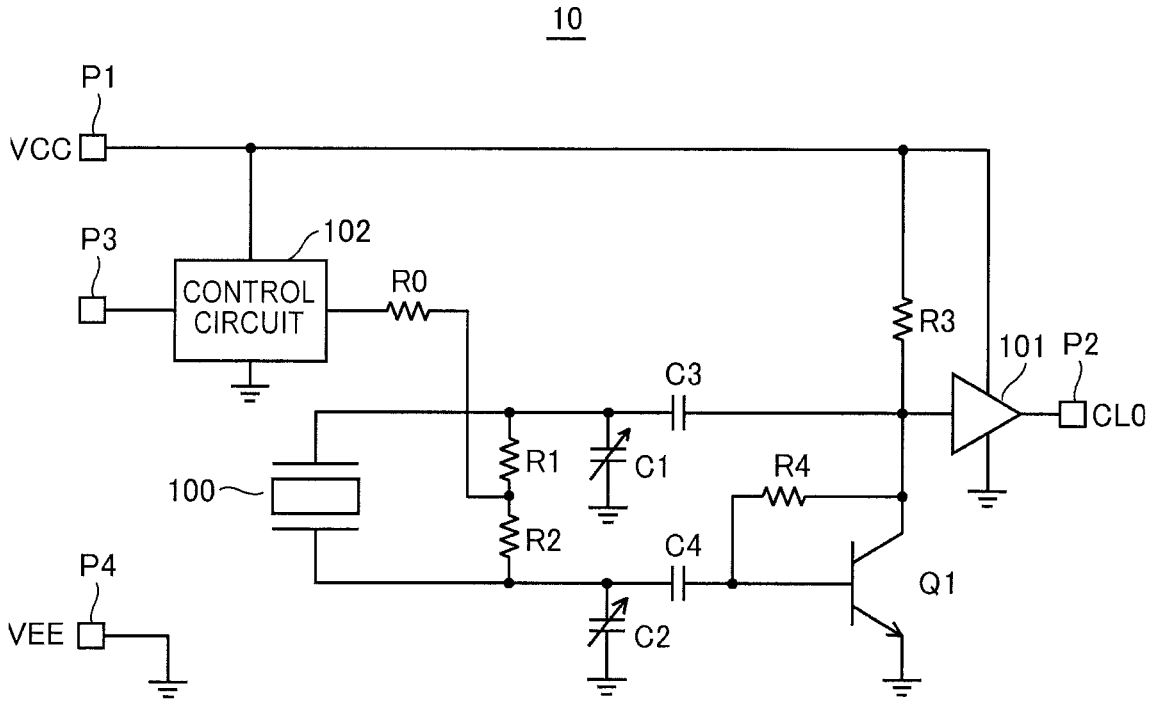
FIG. 2 is a circuit diagram showing an example configuration of an oscillator circuit shown in FIG. 1.

FIG. 2 is a circuit diagram showing an example configuration of the oscillator circuit shown in FIG. 1. As shown in FIG. 2, the oscillator circuit 10 includes an NPN bipolar transistor Q1, capacitors C1 to C4, resistors R0 to R4, a crystal oscillator body 100, a buffer amplifier 101 and a control circuit 102.

A power supply terminal P1 receives a supply of a power supply potential VCC, and a power supply terminal P4 receives a supply of a reference potential VEE. The resistors R1 and R2 are connected in series between two electrodes of the crystal oscillator body 100. The resistor R0 is connected between the control circuit 102 and a junction point between the resistors R1 and R2.

The capacitors C1 and C2 are respectively connected between two electrodes of the crystal oscillator body 100 and wiring of the reference potential VEE. The capacitor C3 is connected in series between one of the electrodes of the crystal oscillator body 100 and a collector of the transistor Q1, and the capacitor C4 is connected between the other electrode of the crystal oscillator body 100 and a base of the transistor Q1.

The collector of the transistor Q1 is connected to wiring of the power supply potential VCC via the resistor R3, and an emitter of the transistor Q1 is connected to the wiring of the reference potential VEE. The resistor R4 is connected between the collector and the base of the transistor Q1. The buffer amplifier 101 buffers an oscillating signal generated at the collector of the transistor Q1 and outputs the clock signal CL0 from an output terminal P2.

The transistor Q1 performs an inversion amplification operation, and the oscillating signal generated at the collector is fed back to the base via the crystal oscillator body 100 or the like. At this time, the crystal oscillator body 100 vibrates due to an alternating voltage applied by the transistor Q1. The vibration is excited significantly at an intrinsic resonance frequency, and the crystal oscillator body 100 acts as a negative resistor. As a result, the oscillator circuit 10 oscillates mainly at an oscillator frequency determined by the resonance frequency of the crystal oscillator body 100.

Note that the oscillator frequency of the oscillator circuit 10 can be finely adjusted by changing the capacitance value of the capacitor C1 or C2. Accordingly, in the example shown in FIG. 2, the capacitors C1 and C2 are formed of, for example, variable capacitance diodes (varactor diodes) whose capacitance value varies according to the control voltage. The variable capacitance diodes change the capacitance value according to a reverse bias voltage applied between the anode and the cathode.

A control terminal P3 receives an input of a control signal for controlling the oscillator frequency of the oscillator circuit 10. The control circuit 102 includes a memory such as a non-volatile memory, and sets, in the memory, for example, data for controlling the oscillator frequency of the oscillator circuit 10 according to the input signal. Also, the control circuit 102 generates control voltages for controlling the capacitance values of the capacitors C1 and C2 based on the data stored in the memory, and supplies the generated control voltages to the capacitors C1 and C2 via the resistors R0 to R2. Through the above process, the oscillator frequency of the oscillator circuit 10 can be controlled from the outside.

As the oscillator circuit 10 shown in FIG. 1, other than the crystal oscillator circuit, it is possible to use an oscillator circuit that uses a piezoelectric element, a SAW (surface acoustic wave) resonator, an electrostatic capacitive resonator or the like. Alternatively, it is possible to omit the oscillator circuit 10 and use a configuration in which the original oscillating clock signal CL0 is supplied from an external circuit to the frequency divider circuit 20 via the bus interface 80 or the like.

The frequency divider circuit 20 generates a frequency-divided clock signal CL1 having a frequency of 1 Hz by dividing the original oscillating clock signal CL0. The frequency divider circuit 20 is formed of, for example, a plurality of connected ½ frequency divider circuits that use D-flip-flops.

Figure 3:
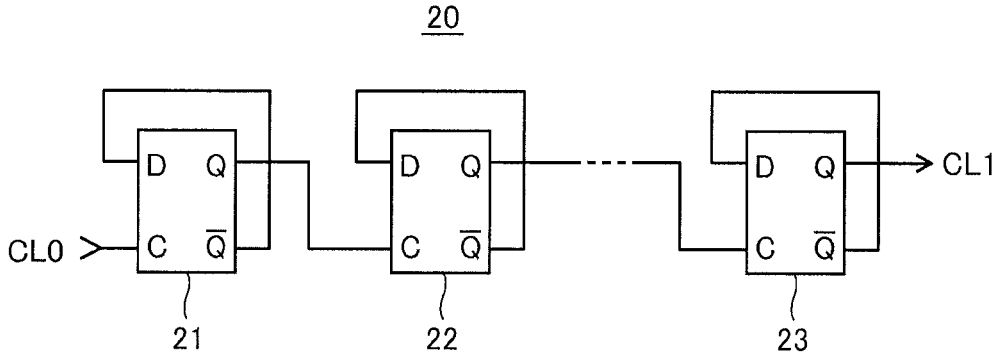
FIG. 3 is a circuit diagram showing an example configuration of a frequency divider circuit shown in FIG. 1.

FIG. 3 is a circuit diagram showing an example configuration of the frequency divider circuit shown in FIG. 1. As shown in FIG. 3, the frequency divider circuit 20 includes a plurality of D-flip-flops 21, 22, . . . , 23. Each flip-flop inputs an inverted output signal output from an inverted output terminal Q bar to a data input terminal D so as to perform ½ frequency division on the clock signal input into a clock signal input terminal C.

Through the above process, the frequency-divided clock signals output from the D-flip-flops 21, 22, . . . , 23 have a frequency of, for example, 16,384 Hz, 8,192 Hz and so on 1 Hz, respectively. In general, when the original oscillating clock signal CL0 has a frequency of 2" (where N is a natural number), by performing ½" frequency division on the original oscillating clock signal CL0 by using the frequency divider circuit 20 including N D-flip-flops, a frequency-divided clock signal CL1 having a frequency of 1 Hz can be obtained.

Referring back to FIG. 1, the lower counter 30, which is a first counter, generates a first count value that indicates the time in seconds by performing a count operation in synchronization with the frequency-divided clock signal CL1 generated by the frequency divider circuit 20. For example, the lower counter 30 sequentially generates a first count value (binary value) indicating any one of "0" to "59" in synchronization with the rising edge of the frequency-divided clock signal CL1. Also, the lower counter 30 outputs a carry signal CA1 by comparing the first count value with a predetermined value.

Figure 4:
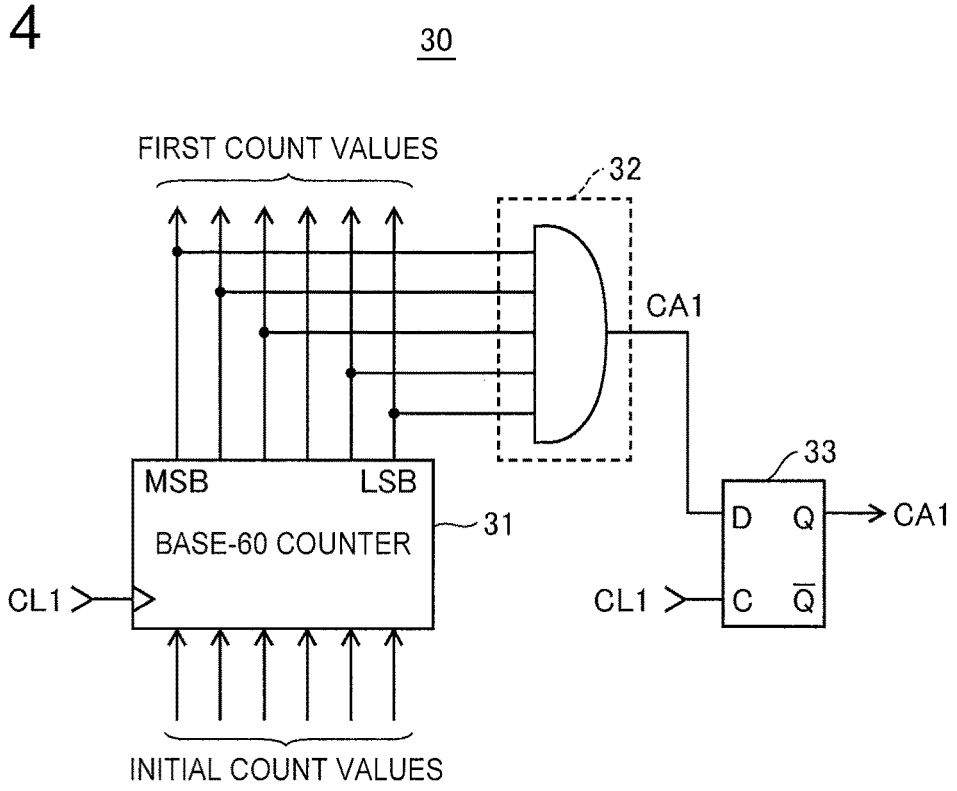
FIG. 4 is a circuit diagram showing an example configuration of a lower counter shown in FIG. 1.

FIG. 4 is a circuit diagram showing an example configuration of the lower counter shown in FIG. 1. As shown in FIG. 4, the lower counter 30 includes a base-60 counter 31, a comparator circuit 32 and a D-flip-flop 33. In the base-60 counter 31, an initial count value can be set, and the first count value is incremented by one in synchronization with the rising edge of the frequency-divided clock signal CL1.

The comparator circuit 32 is formed of, for example, an AND circuit, and activates the carry signal CA1 to a high level when the first count value output from the base-60 counter 31 is equal to a predetermined value of "59". The D-flip-flop 33 outputs the carry signal CA1 in synchronization with the rising edge of the next frequency-divided clock signal CL1. Accordingly, the carry signal CA1 is output when the first count value transitions from "59" to the next value of "0". The comparator circuit 32 deactivates the carry signal CA1 to a low level after the first count value has transitioned to "0".

Referring back to FIG. 1, in the present embodiment, a plurality of groups of upper counters 40, 50, 60 and so on are provided in order to generate timing information regarding the times in a plurality of regions. Note that the upper counters 40, 50, 60 and so on perform a count operation in synchronization with the carry signal having a period of 60 seconds or more, and thus they perform operations with much lower power consumption than the frequency divider circuit 20 and the lower counter 30.

The first group of upper counters 40 performs a count operation in synchronization with the counter operation performed by the lower counter 30 based on a first group of initial count values that indicate the time in, for example, Tokyo. The second group of upper counters 50 performs a count operation in synchronization with the counter operation performed by the lower counter 30 based on a second group of initial count values that indicate the time in, for example, New York.

Furthermore, the third group of upper counters 60 performs a count operation in synchronization with the counter operation performed by the lower counter 30 based on a third group of initial count values that indicate the time in, for example, Paris. Through the above process, the first group of upper counters 40, the second group of counters 50 and the third group of upper counters 60 respectively generate a first group of count values, a second group of count values and a third group of count values, the count values indicating the time in minutes, hours, days, months and years.

According to the first embodiment, one frequency divider circuit 20 generates a frequency-divided clock signal CL1, one lower counter 30 performs a per-second timing operation in synchronization with the frequency-divided clock signal CL1, and a plurality of groups of upper counters 40, 50, 60 and so on perform a count operation based on their initial count values in synchronization with the count operation performed by the lower counter 30. Accordingly, it is possible to generate timing information regarding a plurality of regions without performing a complex calculation that uses software and without causing a significant increase in electric current consumption.

For example, the first group of upper counters 40 includes a second counter 42 that generates a second count value that indicates the time in minutes and a third counter 43 that generates a third count value that indicates the time in hours. Likewise, the second group of upper counters 50 includes a second counter 52 and a third counter 53, and the third group of upper counters 60 includes a second counter 62 and a third counter 63.

Furthermore, the first group of upper counters 40 may include a fourth counter 44 that generates a fourth count value that indicates the time in days, a fifth counter 45 that generates a fifth count value that indicates the time in months and a sixth counter 46 that generates a sixth count value that indicates the time in years. Likewise, the second group of upper counters 50 may include a fourth counter 54, a fifth counter 55 and a sixth counter 56, and the third group of upper counters 60 may include a fourth counter 64, a fifth counter 65 and a sixth counter 66.

The following description will be given mainly focusing on the first group of upper counters 40 as a representative example of the plurality of groups of upper counters. The second counter 42 included in the first group of upper counters 40 generates a second count value that indicates the time in minutes by performing a count operation in synchronization with the carry signal CA1 output from the lower counter 30, which is a first counter. For example, the second counter 42 has the same configuration as the lower counter 30, and sequentially generates a second count value (binary value) indicating any one of "0" to "59" in synchronization with the rising edge of the carry signal CA1.

Also, the second counter 42 outputs a carry signal CA2 by comparing the second count value with a predetermined value. For example, the second counter 42 activates the carry signal CA2 to a high level when the second count value is equal to a predetermined value of "59", and outputs the carry signal CA2 in synchronization with the next rising edge of the carry signal CA1. Accordingly, the carry signal CA2 is output when the second count value transitions from "59" to the next value of "0". The second counter 42 deactivates the carry signal CA2 to a low level after the second count value has transitioned to "0".

The third counter 43 generates a third count value that indicates the time in hours by performing a count operation in synchronization with the carry signal CA2 output from the second counter 42. For example, the third counter 43 includes a base-24 counter, and sequentially generates a third count value (binary value) indicating any one of "0" to "23" in synchronization with the rising edge of the carry signal CA2.

Also, the third counter 43 outputs a carry signal CA3 by comparing the third count value with a predetermined value. For example, the third counter 43 activates the carry signal CA3 to a high level when the third count value is equal to a predetermined value of "23", and outputs the carry signal CA3 in synchronization with the next rising edge of the carry signal CA2. Accordingly, the carry signal CA3 is output when the third count value transitions from "23" to the next value of "0". The third counter 43 deactivates the carry signal CA3 to a low level after the third count value has transitioned to "0".

The fourth counter 44 generates a fourth count value that indicates the time in days in synchronization with the carry signal CA3 output from the third counter 43. For example, the fourth counter 44 sequentially generate a fourth count value (binary value) indicating any one of "1" to "31" in synchronization with the rising edge of the carry signal CA3.

However, it is necessary to set the last day of the month to "28" or "30" depending on the month. In the case of the month of February in a leap year, the last day of the month needs to be set to "29". Accordingly, the fourth counter 44 controls the count operations of the fifth counter 45 and the sixth counter 46 and resets the fourth count value by comparing the fourth count value with an upper limit count value set based on the fifth and sixth count values.

Figure 5:
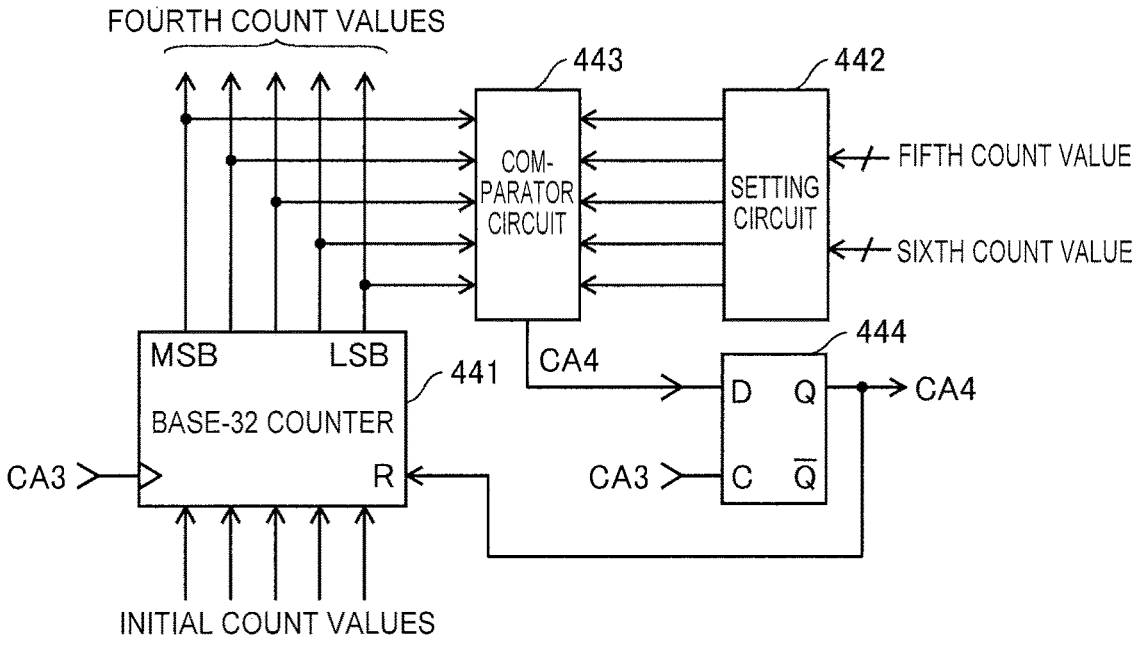
FIG. 5 is a circuit diagram showing an example configuration of a fourth counter shown in FIG. 1.

FIG. 5 is a circuit diagram showing an example configuration of the fourth counter shown in FIG. 1. As shown in FIG. 5, the fourth counter 44 includes a base-32 counter 441, a setting circuit 442, a comparator circuit 443 and a D-flip-flop 444. The setting circuit 442 and the comparator circuit 443 are formed of, for example, a logic circuit including a combinational circuit or a sequential circuit, or the like.

In the base-32 counter 441, an initial count value can be set, and the fourth count value is incremented by one in synchronization with the rising edge of the carry signal CA3. The setting circuit 442 sets the upper limit count value based on the fifth count value output from the fifth counter 45 and the sixth count value output from the sixth counter 46 shown in FIG. 1.

For example, the setting circuit 442 sets the upper limit count value to "31" if the month indicated by the fifth count value is January, March, May, July, August, October or December. Also, the setting circuit 442 sets the upper limit count value to "30" if the month indicated by the fifth count value is April, June, September or November.

If the month indicated by the fifth count value is February, the setting circuit 442 determines whether or not the year indicated by the sixth count value is a leap year. If the year (Western calendar year) indicated by the sixth count value is a year that is divisible by 4, and at the same time, it is not a year that is divisible by 100 but is indivisible by 400, it is determined that the year indicated by the sixth count value is a leap year.

Accordingly, if it is determined that the month indicated by the fifth count value is February and the year indicated by the sixth count value is a leap year, the setting circuit 442 sets the upper limit count value to "29". If, on the other hand, it is determined that the month indicated by the fifth count value is February and the year indicated by the sixth count value is not a leap year, the setting circuit 442 sets the upper limit count value to "28".

The comparator circuit 443 activates a carry signal CA4 to a high level when the fourth count value output from the base-32 counter 441 is equal to the upper limit count value set by the setting circuit 442. The D-flip-flop 444 outputs the carry signal CA4 in synchronization with the next rising edge of the carry signal CA3. The carry signal CA4 output from the D-flip-flop 444 is also supplied to a reset terminal of the base-32 counter 441.

For example, if the month indicated by the fifth count value is January, the carry signal CA4 is activated to a high level when the fourth count value is equal to "31", and the carry signal CA4 is output in synchronization with the next rising edge of the carry signal CA3. The fourth count value thereby transitions from "31" to "1". After the fourth count value has transitioned to "1", the comparator circuit 443 deactivates the carry signal CA4 to a low level. In this way, each group of upper counters can independently perform processing for setting the last day of the month and management of leap years for the corresponding region.

Referring back to FIG. 1, the fifth counter 45 generates a fifth count value that indicates the time in months by performing a count operation in synchronization with the carry signal CA4 output from the fourth counter 44. The fifth counter 45 includes, for example, a base-12 counter, and sequentially generates fifth count value (binary value) indicating any one of "1" to "12" in synchronization with the rising edge of the carry signal CA4.

Also, the fifth counter 45 outputs a carry signal CA5 by comparing the fifth count value with a predetermined value. For example, the fifth counter 45 activates the carry signal CA5 to a high level when the fifth count value is equal to a predetermined value of "12", and outputs the carry signal CA5 in synchronization with the next rising edge of the carry signal CA4. Accordingly, the carry signal CA5 is output when the first count value transitions from "12" to the next value of "1". After the fifth count value has transitioned to "1", the fifth counter 45 deactivates the carry signal CA5 to a low level.

The sixth counter 46 generates a sixth count value that indicates the time in years by performing a count operation in synchronization with the carry signal CA5 output from the fifth counter 45. For example, the sixth counter 46 sequentially generates a sixth count value (binary value) indicating any one of Western calendar years such as "2015", "2016", "2017" and so on in synchronization with the rising edge of the carry signal CA5.

In regions where summer time (also called daylight saving time) is adopted, it is necessary to measure the time corresponding to their summer time. In the example shown in FIG. 1, the first group of upper counters 40 is provided for a region where summer time is not adopted. Accordingly, in the first group of upper counters 40, the third counter 43 maintains an interval of performing control to advance with the count operation of the fourth counter 44 at a constant interval.

On the other hand, the second group of upper counters 50 is provided for a region where summer time is adopted. Accordingly, in the second group of upper counters 50, the third counter 53 changes the interval of performing control to advance with the count operation of the fourth counter 44 based on the fourth count value output from the fourth counter 54 and the fifth count value output from the fifth counter 55.

That is, the third counter 53 performs a count operation in synchronization with the carry signal CA2 output from the second counter 52 except on the first day and the last day of summer time so as to generate the third count value that indicates the time in hours. On the other hand, the third counter 53 increases the number of counts on the first day of summer time based on the fourth and the fifth count values and decreases the number of counts on the last day of summer time.

Figure 6:
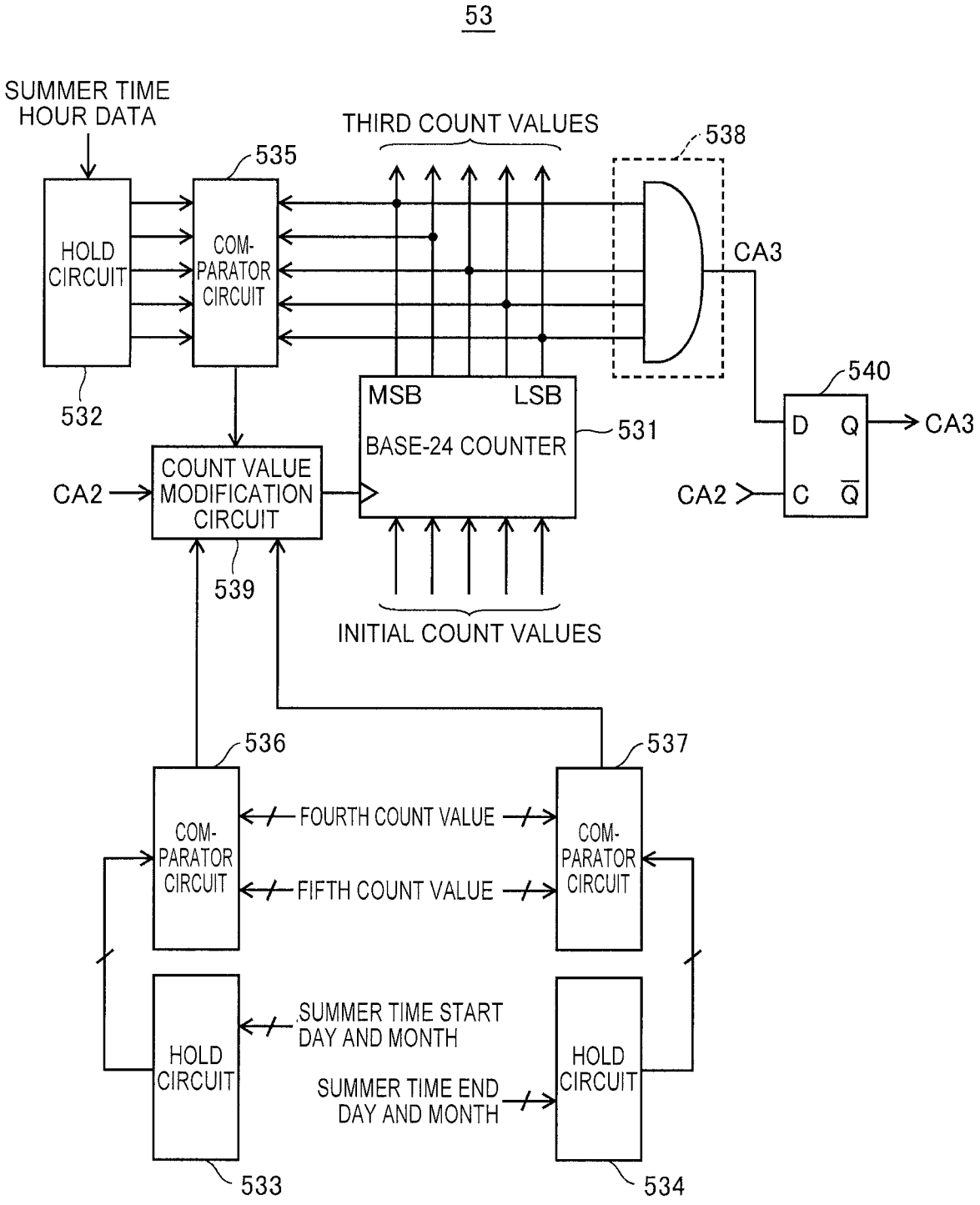
FIG. 6 is a circuit diagram showing an example configuration of a third counter in a second group of upper counters.

FIG. 6 is a circuit diagram showing an example configuration of the third counter included in the second group of upper counters shown in FIG. 1. As shown in FIG. 6, the third counter 53 includes a base-24 counter 531, hold circuits 532 to 534, comparator circuits 535 to 538, a count value modification circuit 539 and a D-flip-flop 540. The hold circuits 532 to 534 are formed of, for example, memories, registers or the like. The comparator circuits 535 to 537 and the count value modification circuit 539 are formed of, for example, a logic circuit including a combinational circuit or a sequential circuit, or the like. The comparator circuit 538 is formed of, for example, an AND circuit.

In the base-24 counter 531, an initial count value can be set, and the third count value is incremented by one in synchronization with the rising edge of an output signal of the count value modification circuit 539. The hold circuit 532 holds summer time hour data that indicates what time summer time starts or ends (the following description will be given assuming that the time is two o'clock). The hold circuit 533 holds summer time start month/day data that indicates what month and day summer time starts, and the hold circuit 534 holds summer time end month/day data that indicates what month and day summer time ends.

The comparator circuit 535 activates an output signal when the time in hours indicated by the third count value output from the base-24 counter 531 is equal to the time (two o'clock) indicated by the summer time hour data. The comparator circuits 536 and 537 receive a supply of the fourth count value from the fourth counter 54 shown in FIG. 1 and also receive a supply of the fifth count value from the fifth counter 55. The comparator circuit 536 activates an output signal when the day and month indicated by the fourth and fifth count values are equal to the summer time start day and month. The comparator circuit 536 activates the output signal when the day and month indicated by the fourth and fifth count values are equal to the summer time end day and month.

The count value modification circuit 539 outputs, to the base-24 counter 531, an output signal having the same level as that of the carry signal CA2 supplied from the second counter 52 shown in FIG. 1 except when the output signals of the comparator circuits 535 and 536 are activated and when the output signals of the comparator circuit 535 and 537 are activated. At this time, the base-24 counter 531 increments the third count value in synchronization with the carry signal CA2.

When the third count value takes a value of "2" on the first day of summer time, the output signals of the comparator circuits 535 and 536 are activated. At this time, the count value modification circuit 539 temporarily changes the output signals activated to a high level according to the carry signal CA2 to a low level and again sets the output signals back to a high level. The base-24 counter 531 thereby increments the third count value to "3", and thus the time indicated by the third count value progresses by one hour. The comparator circuit 535 deactivates the output signal to a low level when the third count value takes a value of "3".

When the third count value takes a value of "2" on the last day of summer time, the output signals of the comparator circuits 535 and 537 are activated. At this time, the count value modification circuit 539 maintains the output signals to a low level even when the carry signal CA2 is activated to a high level the next time, and the count value modification circuit 539 activates the output signals to a high level when the carry signal CA2 is activated to a high level after the next time. The base-24 counter 531 thereby increments the third count value to "3" with a delay of one period of the carry signal CA2 with respect to normal conditions, and thus the time indicated by the third count value is delayed by one hour. Also, the comparator circuit 535 deactivates the output signal to a low level when the third count value takes a value of "3".

The comparator circuit 538 activates the carry signal CA3 to a high level when the third count value output from the base-24 counter 531 is equal to a predetermined value of "23". The D-flip-flop 540 outputs the carry signal CA3 in synchronization with the next rising edge of the carry signal CA2. In this way, the second group of upper counters 50 can generate timing information so as to follow a change in the length of one day caused by summer time.

Figure 7:
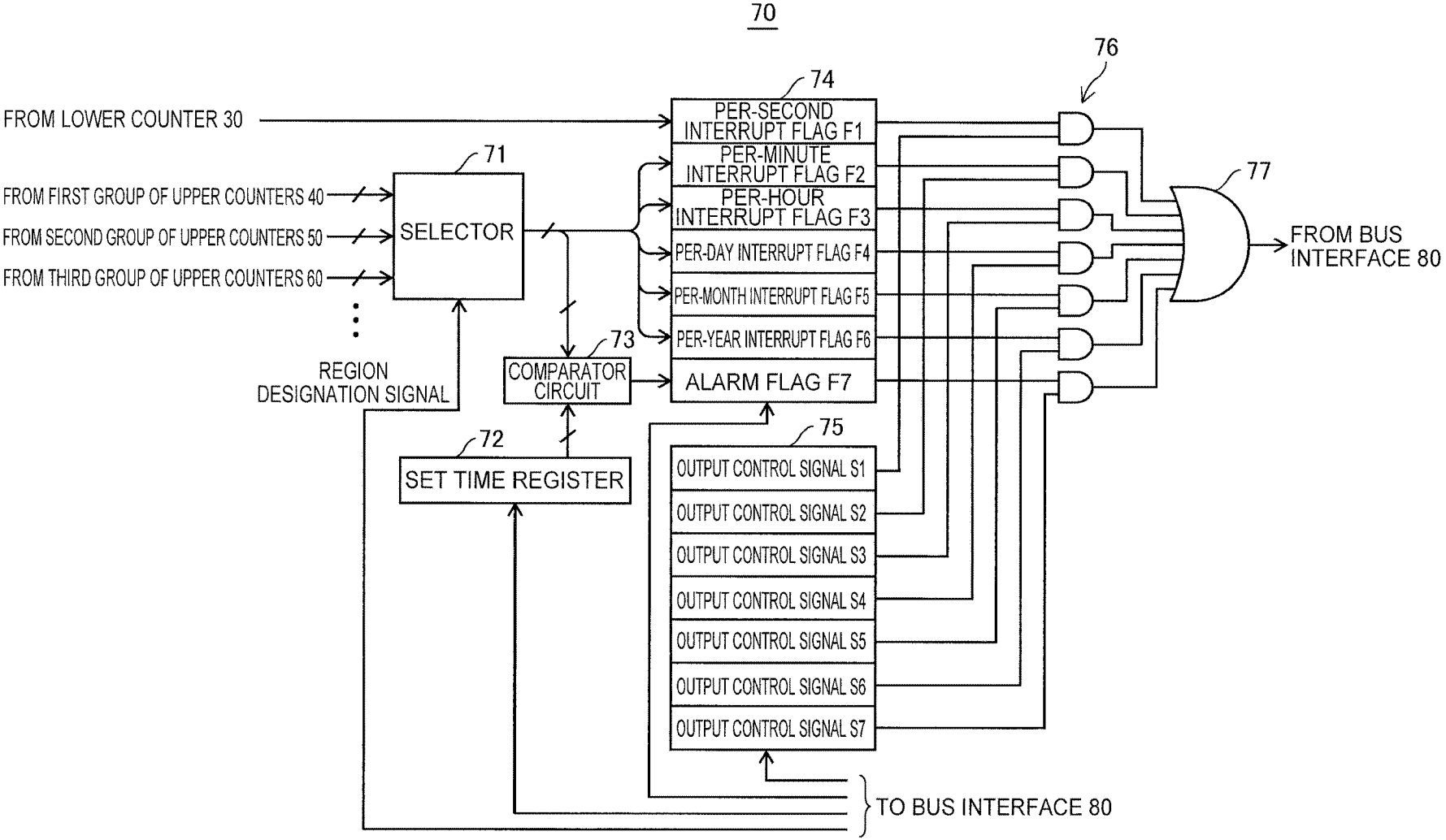
FIG. 7 is a circuit diagram showing an example configuration of an interrupt circuit shown in FIG. 1.

FIG. 7 is a circuit diagram showing an example configuration of an interrupt circuit shown in FIG. 1. As shown in FIG. 7, an interrupt circuit 70 includes a selector 71, a set time register 72, a comparator circuit 73, an interrupt signal setting circuit 74, an output control register 75, a plurality of AND circuits 76 and an OR circuit 77.

The comparator circuit 73 and the interrupt signal setting circuit 74 are formed of, for example, a logic circuit including a combinational circuit or a sequential circuit, or the like. The interrupt circuit 70 outputs an interrupt signal (interrupt flag) in response to a change in the count value output from at least one of the lower counter 30 and the plurality of groups of upper counters 40, 50, 60 and so on.

For this reason, the first count value output from the lower counter 30 is supplied to the interrupt signal setting circuit 74. Also, the selector 71 selects the second to sixth count values output from one of the plurality of groups of upper counters 40, 50, 60 and so on in accordance with a region designation signal supplied from an external CPU or the like via the bus interface 80, and supplies the selected count values to the interrupt signal setting circuit 74.

The set time register 72 stores therein set time data supplied from the external CPU or the like via the bus interface 80. The comparator circuit 73 performs comparison between a measurement time indicated by a predetermined number of count values selected by the selector 71 and a set time indicated by the set time data stored in the set time register 72, and outputs a signal that indicates the result of comparison.

The interrupt signal setting circuit 74 sets a per-second interrupt flag F1 to "1" (high level) in response to a change in the first count value supplied from the lower counter 30. Also, the interrupt signal setting circuit 74 sets a per-minute interrupt flag F2, a per-hour interrupt flag F3, a per-day interrupt flag F4, a per-month interrupt flag F5 and a per-year interrupt flag F6 to "1" in response to changes in the second to sixth count values selected by the selector 71. Furthermore, the interrupt signal setting circuit 74 sets an alarm flag F7 to "1" in accordance with an output signal of the comparator circuit 73 when the measurement time and the set time match.

The output control register 75 stores therein output control signals S1 to S7 supplied from the external CPU or the like via the bus interface 80. The plurality of AND circuits 76 obtain logical ANDs between the interrupt flags F1 to F7 and the output control signals S1 to S7, and output a plurality of interrupt signals that indicate the obtained logical ANDs to the OR circuit 77. The OR circuit 77 outputs the interrupt signals activated to a high level to the bus interface 80.

The bus interface 80 outputs the interrupt signals output from the interrupt circuit 70 to the external CPU or the like together with the first count value output from the lower counter 30 and the second to sixth count values output from the plurality of groups of upper counters 40, 50, 60 and so on. It is thereby possible to perform an alarm operation or the like at the corresponding time in the desired region. Here, the selector 71 may be omitted, and a configuration may be used in which a plurality of interrupt signal setting circuits 74 and output control registers 75 are provided so as to correspond to all of the count values output from the plurality of groups of upper counters 40, 50, 60 and so on.

Referring back to FIG. 1, in the case where the timing apparatus 110 is used in a personal computer or the like that performs operations by receiving a supply of AC power from an external source, in the event that power supply from the external source stops, the backup power supply 90 supplies a power supply voltage to the oscillator circuit 10, the frequency divider circuit 20, the lower counter 30 and the plurality of groups of upper counters 40, 50, 60 and so on. It is thereby possible to continuously perform the timing operation even if power supply from the external source stops.

Electronic Appliance

An electronic appliance that uses the timing apparatus according to the first embodiment of the invention will be described next with reference to FIGS. 1 and 8.

Figure 8:
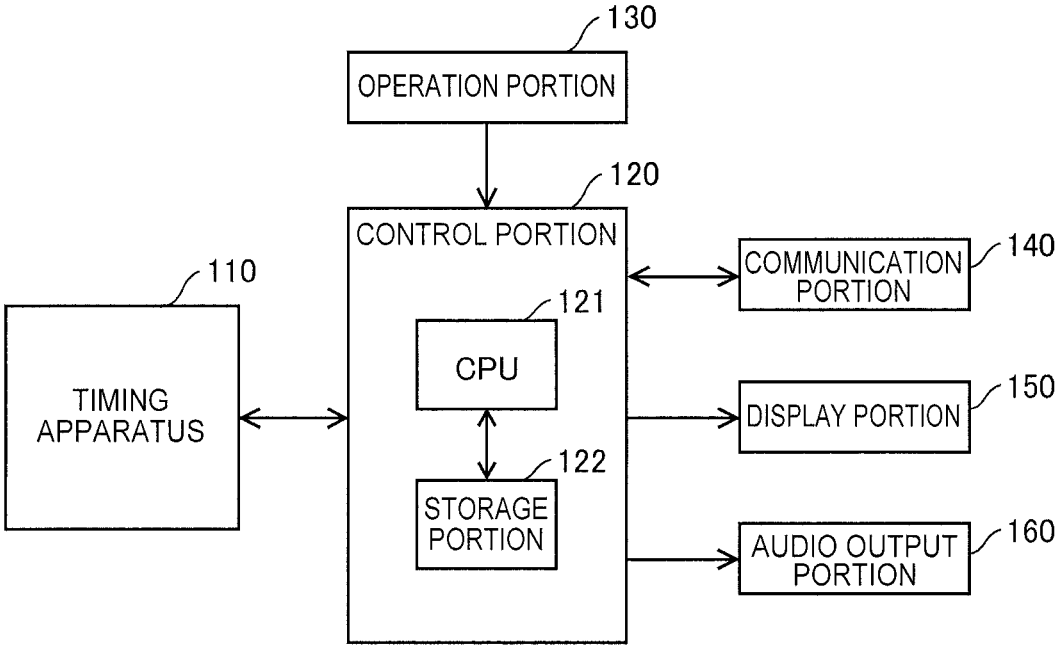
FIG. 8 is a block diagram showing an example configuration of an electronic appliance according to an embodiment of the invention.

FIG. 8 is a block diagram showing an example configuration of an electronic appliance according to an embodiment of the invention. As shown in FIG. 8, the electronic appliance includes the timing apparatus 110, a control portion 120, an operation portion 130, a communication portion 140, a display portion 150 and an audio output portion 160. It is possible to omit or change a part of the constituent elements shown in FIG. 8. Alternatively, an additional constituent element(s) may be provided to the constituent elements shown in FIG. 8.

The control portion 120 includes a CPU (central processing unit) 121 and a storage portion 122. The CPU 121 performs operations based on software (timing program) recorded in a recording medium in the storage portion 122. The recording medium can be, for example, a hard disk, a flexible disk, a MO, a MT, any type of memory, a CD-ROM or a DVD-ROM.

The operation portion 130 is an input apparatus including, for example, an operation keypad, a button switch and the like, and outputs, to the CPU 121, an operation signal corresponding to an operation input by the user. The communication portion 140 is formed of, for example, an analog circuit and a digital circuit, and performs data communication between the CPU 121 and an external apparatus. The display portion 150 includes, for example, an LCD (liquid crystal display apparatus) and the like, and displays various types of information based on an image signal supplied from the CPU 121. The audio output portion 160 includes, for example, a speaker and the like, and generates audio based on an audio signal supplied from the CPU 121.

The electronic appliance is capable of displaying the time in a plurality of regions around the world on the display portion 150. Accordingly, the plurality of groups of upper counters 40, 50, 60 and so on of the timing apparatus 110 are assigned to a plurality of regions around the world. Also, in the storage portion 122, information regarding the time difference between a first region (for example, Tokyo) and a second region (for example, New York) among a plurality of regions around the world is stored.

The operation portion 130 is configured so as to be capable of designating the desired region. If the user designates a desired region through operation of the operation portion 130, a region designation signal that identifies the region is output to the CPU 121. Furthermore, if the user sets the current time in the first region through operation of the operation portion 130, the CPU 121 sets a group of initial count values in a group of upper counters assigned to the first region based on the time set for the first region.

For example, the CPU 121 sets a first group of initial count values that indicate the time (in minutes, hours, days, months and years) set for the first region in the first group of upper counters 40, and sets an initial count value that indicates the time (in seconds) set for the first region in the lower counter 30. Through the above process, the first to sixth count values of the lower counter 30 and the first group of upper counters 40 indicate the current time in the first region.

Also, the CPU 121 sequentially selects a plurality of regions other than the first region, calculates the time in a second region based on the time set for the first region and the time difference in the selected second region, and sets a group of initial count values in a group of upper counters assigned to the second region.

For example, the CPU 121 sets a second group of initial count values that indicate the time (in minutes, hours, days, months and years) calculated for the second region in the second group of upper counters 50. Through the above process, the first to sixth count values of the lower counter 30 and the second group of upper counters 50 indicate the current time in the second region.

By setting the current time in the first region in the manner as described above, the current time in the second region can also be set. Alternatively, the user may set the current time in any one of a plurality of regions around the world through operation of the operation portion 130.

If thereafter the user designates a desired region through operation of the operation portion 130, the CPU 121 generates an image signal that indicates the time in the designated region based on the first count value output from the lower counter 30 and the second to sixth count values output from a group of upper counters assigned to the designated region, and outputs the generated image signal to the display portion 150. Through the above process, the time in the designated region is displayed on the display portion 150.

A configuration is also possible in which upon the CPU 121 supplying a region designation signal to the selector 71 (FIG. 7), the timing apparatus 110 performs an interrupt operation at the corresponding time in the desired region. Thus, the CPU 121 performs operations in accordance with an operation of the user who uses the operation portion 130 such as supplying set time data to the set time register 72 (FIG. 7) and supplying output control signals S1 to S7 to the output control register 75 (FIG. 7).

For example, if an output control signal S3 that indicates "1" is stored in the output control register 75, the per-hour interrupt flag F3 stored in the interrupt signal setting circuit 74 is output to the CPU 121. In response to the per-hour interrupt flag F3 that indicates "1", the CPU 121 generates an audio signal for generating a time announcement sound and resets the per-hour interrupt flag F3 to "0". The audio output portion 160 receives the audio signal every hour from the CPU 121 and generates a time announcement sound.

If an output control signal S7 that indicates "1" is stored in the output control register 75, the alarm flag F7 stored in the interrupt signal setting circuit 74 is output to the CPU 121. In response to the alarm flag F7 that indicates "1", the CPU 121 generates an audio signal for generating an alarm sound and resets the alarm flag F7 to "0". The audio output portion 160 receives the audio signal from the CPU 121 and generates an alarm sound. Alternatively, the alarm flag F7 may be used to operate an on/off timer.

Examples of the electronic appliance include time pieces such as a wrist watch and a desk clock, digital still cameras, digital movies, mobile terminals such as a mobile phone, multifunctional peripherals, robots, on-board apparatuses (a navigation apparatus, and the like), electronic calculators, electronic dictionaries, electronic gaming devices, head-mounted displays, personal computers, printers, network devices, measurement devices and medical devices.

According to the present embodiment, it is possible to generate timing information regarding a plurality of regions without performing a complex calculation that uses software and without causing a significant increase in electric current consumption. Accordingly, even a low power consumption electronic appliance that uses a CPU having a low processing capability can readily generate timing information regarding a plurality of regions.

Second Embodiment

Figure 9:
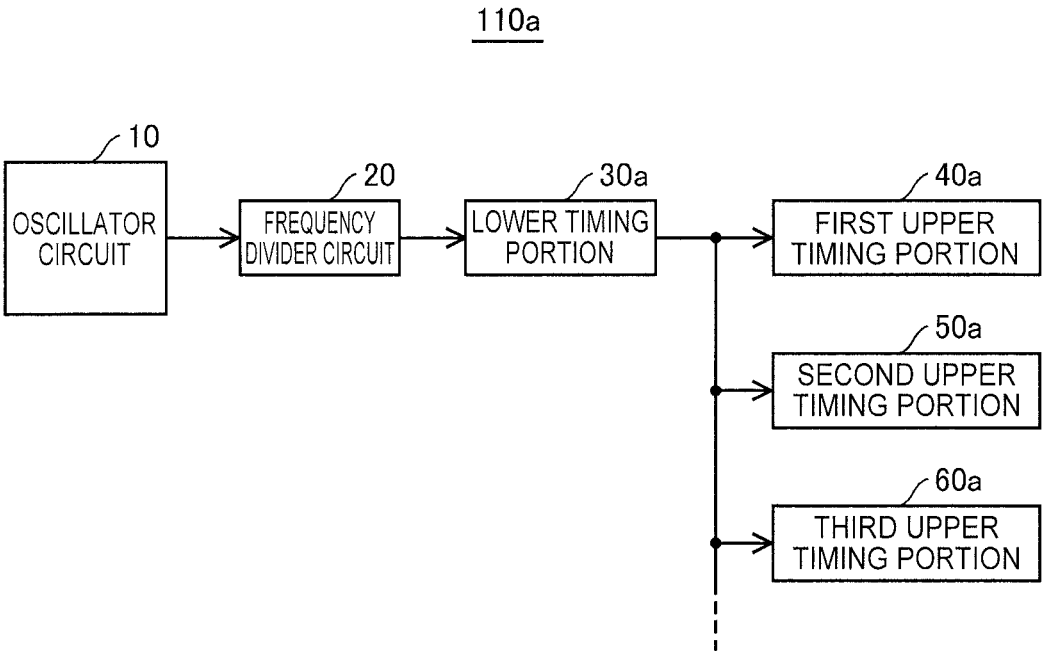
FIG. 9 is a block diagram showing an example configuration of a timing apparatus according to a second embodiment of the invention.

FIG. 9 is a block diagram showing an example configuration of a timing apparatus according to a second embodiment of the invention. As shown in FIG. 9, a timing apparatus 110*a* includes an oscillator circuit 10, a frequency divider circuit 20, a lower timing portion 30*a* and a plurality of upper timing portions 40*a*, 50*a*, 60*a* and so on, and the timing apparatus 110*a* has a real time clock (RTC) function.

The timing apparatus 110*a* according to the second embodiment also can be used to constitute an electronic appliance shown in FIG. 8, as with the timing apparatus 110 according to the first embodiment shown in FIG. 1. As with the first embodiment, the timing apparatus 110*a* may further include an interrupt circuit 70, a bus interface 80 and a backup power supply 90. Also, the oscillator circuit 10 may be omitted, and a configuration may be used in which the original oscillating clock signal is supplied from an external circuit to the frequency divider circuit 20.

The lower timing portion 30*a* and the plurality of upper timing portions 40*a*, 50*a*, 60*a* and so on are formed of, for example, a logic circuit including a combinational circuit or a sequential circuit, or the like. The lower timing portion 30*a* generates timing information regarding the time in seconds by performing a timing operation by using a frequency-divided clock signal generated by the frequency divider circuit 20. The timing information generated by the lower timing portion 30*a* includes, for example, a first timing signal that indicates the time in seconds and a first carry signal activated every 60 seconds based on the time in seconds.

The first upper timing portion 40*a* generates timing information regarding the time in a first region (for example, Tokyo) in minutes, hours, days, months and years by performing a timing operation by using the timing information generated by the lower timing portion 30*a*. The second upper timing portion 50*a* generates timing information regarding the time in a second region (for example, New York) in minutes, hours, days, months and years by performing a timing operation by using the timing information generated by the lower timing portion 30*a*.

The third upper timing portion 60*a* generates timing information regarding the time in a third region (for example, Paris) in minutes, hours, days, months and years by performing a timing operation by using the timing information generated by the lower timing portion 30*a*. The timing information generated by each of the upper timing portions 40*a*, 50*a*, 60*a* and so on includes, for example, second to sixth timing signals that respectively indicate the time in minutes, the time in hours, the time in days, the time in months and the time in years and second to fifth carry signals activated respectively based on the time in minutes, the time in hours, the time in days and the time in months.

According to the second embodiment, one frequency divider circuit 20 generates a frequency-divided clock signal, one lower timing portion 30*a* performs a per-second timing operation by using the frequency-divided clock signal, and a plurality of upper timing portions 40*a*, 50*a*, 60*a* and so on generate timing information in the corresponding region by using the timing information generated by the lower timing portion 30*a*. Accordingly, timing information regarding a plurality of regions can be generated without performing a complex calculation that uses software and without causing a significant increase in electric current consumption.

Timing Method

A timing method according to an embodiment of the invention will be described next. The timing method is carried out by using, for example, the timing apparatus shown in FIG. 9.

In step (a), the frequency divider circuit 20 generates a frequency-divided clock signal by dividing an original oscillating clock signal generated by the oscillator circuit 10. In step (b), the lower timing portion 30*a* generates timing information regarding the time in seconds by performing a timing operation by using the frequency-divided clock signal generated in step (a).

In step (c), the first upper timing portion 40*a* generates timing information regarding the time in a first region (for example, Tokyo) in minutes, hours, days, months and years by performing a timing operation by using the timing information generated in step (b). In step (d), the second upper timing portion 50*a* generates timing information regarding the time in a second region (for example, New York) in minutes, hours, days, months and years by performing a timing operation by using the timing information generated in step (b). In step (e), the third upper timing portion 60*a* generates timing information regarding the time in a third region (for example, Paris) in minutes, hours, days, months and years by performing a timing operation by using the timing information generated in step (b).

According to the present embodiment, in step (a), a frequency-divided clock signal is generated. In step (b), a per-second timing operation is performed by using the frequency-divided clock signal. In steps (c) to (e), timing information generated through the per-second timing operation is used to generate timing information in each region. Accordingly, timing information regarding a plurality of regions can be generated without performing a complex calculation that uses software and without causing a significant increase in electric current consumption.

It is to be noted that the invention is not limited to the embodiments described above. Accordingly, many various modifications can be made by a person having ordinary skill in the art within the technical scope of the invention.

The entire disclosure of Japanese Patent Application No. 2015-182810, filed Sep. 16, 2015 is expressly incorporated by reference herein.

What is claimed is:

1. A timing apparatus comprising:

a frequency divider circuit that generates a frequency-divided clock signal by dividing an original oscillating clock signal;

a lower counter that generates a count value that indicates a time in seconds by performing a count operation in synchronization with the frequency-divided clock signal generated by the frequency divider circuit;

a first group of upper counters that generates a first group of count values that indicate a time in minutes, hours, days, months and years by performing a count operation in synchronization with the count operation performed by the lower counter based on a first group of initial count values;

a second group of upper counters that generates a second group of count values that indicate a time in minutes, hours, days, months and years by performing a count operation in synchronization with the count operation performed by the lower counter based on a second group of initial count values; and a logic circuit that outputs an interrupt signal in accordance with a flag selected by output control signals in a plurality of interrupt flags and an alarm flag, the logic circuit comprising:

a selector that selects the count values output from one of the plurality of groups of upper counters in accordance with a region designation signal, a comparator circuit that performs comparison between a measurement time indicated by a predetermined number of count values selected by the selector and a set time, and outputs a signal that indicates the result of comparison, and an interrupt signal setting circuit that sets the interrupt flags to appropriate level in response to changes in the count values selected by the selector, and the alarm flag to appropriate level in accordance with an output signal of the comparator circuit when the measurement time and the set time match.

2. The timing apparatus according to claim 1, wherein each group of upper counters comprises: a second counter that generates a second count value that indicates a time in minutes; a third counter that generates a third count value that indicates a time in hours; a fourth counter that generates a fourth count value that indicates a time in days; a fifth counter that generates a fifth count value that indicates a time in months; and a sixth counter that generates a sixth count value that indicates a time in years, and the fourth counter controls count operations performed by the fifth counter and the sixth counter and resets the fourth count value by comparing the fourth count value with an upper limit count value set based on the fifth count value and the sixth count value.

3. The timing apparatus according to claim 2, wherein in the first group of upper counters, the third counter maintains an interval of performing control to advance with a count operation performed by the fourth counter at a constant interval, and in the second group of upper counters, the third counter changes the interval of performing control to advance with the count operation performed by the fourth counter based on the fourth count value and the fifth count value.

4. An electronic appliance comprising:

the timing apparatus according to claim 1; and a control portion that sets the first group of initial count values in the first group of upper counters based on a time set for a first region and sets the second group of initial count values in the second group of upper counters based on the time set for the first region and a time difference in a second region.

5. An electronic appliance comprising the timing apparatus according to claim 1.

6. The timing apparatus according to claim 1, wherein the first group of initial count values and the second group of initial count values are different groups.

7. The timing apparatus according to claim 1, wherein the interrupt circuit sets a per-second interrupt flag in response to a change in a first count value supplied from the lower counter, and a per-minute interrupt flag, a per-hour interrupt flag, a per-day interrupt flag, a per-month interrupt flag and a per-year interrupt flag in response to changes in second to sixth count values selected by a selector from the at least one of the counters included in the first group of upper counters and the second group of upper counters.

8. A method for measuring time using a timing apparatus, the method comprising:

(a) dividing an original oscillating clock signal to provide a frequency-divided clock signal;

(b) determining timing information regarding a time in seconds by performing a timing operation using the frequency-divided clock signal provided in (a);

(c) determining timing information regarding a time in a first region in minutes, hours, days, months and years by performing a timing operation using the timing information determined in (b);

(d) determining timing information regarding a time in a second region in minutes, hours, days, months and years by performing a timing operation using the timing information determined in (b); and (e) outputting an interrupt signal in accordance with a flag selected by output control signals in a plurality of interrupt flags and an alarm flag with a logic circuit, the logic circuit comprising:

a selector that selects the minutes, hours, days, months and years determined from one of the first region and the second region in accordance with a region designation signal, a comparator circuit that performs comparison between a measurement time indicated by a predetermined number of minutes, hours, days, months and years selected by the selector and a set time, and outputs a signal that indicates the result of comparison, and an interrupt signal setting circuit that sets the interrupt flags to appropriate level in response to changes in the minutes, hours, days, months and years selected by the selector, and the alarm flag to appropriate level in accordance with an output signal of the comparator circuit when the measurement time and the set time match.

9. A timing apparatus comprising:

a frequency divider circuit that generates a frequency-divided clock signal by dividing an original oscillating clock signal;

a lower timing portion that generates timing information regarding a time in seconds by performing a timing operation by using the frequency-divided clock signal generated by the frequency divider circuit;

a first upper timing portion that generates timing information regarding a time in a first region in minutes, hours, days, months and years by performing a timing operation by using the timing information generated by the lower timing portion;

a second upper timing portion that generates timing information regarding a time in a second region in minutes, hours, days, months and years by performing a timing operation by using the timing information generated by the lower timing portion; and a logic circuit that outputs an interrupt signal in accordance with a flag selected by output control signals in a plurality of interrupt flags and an alarm flag, the logic circuit comprising:

a selector that selects the timing information output from one of the plurality of groups of upper timing portion in accordance with a region designation signal, a comparator circuit that performs comparison between a measurement time indicated by the timing information selected by the selector and a set time, and outputs a signal that indicates the result of comparison, and an interrupt signal setting circuit that sets the interrupt flags to appropriate level in response to changes in the timing information selected by the selector, and the alarm flag to appropriate level in accordance with an output signal of the comparator circuit when the measurement time and the set time match.

10. An electronic appliance comprising the timing apparatus according to claim 9.

* * * * *